US005391326A

United States Patent [19]

Smith et al.

[11] Patent Number: 5,391,326

[45] Date of Patent: Feb. 21, 1995

[54] GRANULAR LAUNDRY DETERGENT

[75] Inventors: Kim R. Smith, Huntington, Ind.; James E. Borland, Baton Rouge, La.; Terry Crutcher, Fitchburg, Wis.; Joe D. Sauer, Baton Rouge, La.

[73] Assignee: Albemarle Corporation, Richmond, Va.

[21] Appl. No.: 96,399

[22] Filed: Jul. 26, 1993

Related U.S. Application Data

[63] Continuation-in-part of Ser. No. 851,600, Mar. 16, 1992, abandoned.

[51] Int. Cl.[6] ..... C11D 1/831; C11D 1/75; C11D 3/08; C11D 3/12

[52] U.S. Cl. ..... 252/559; 252/547; 252/528; 252/534; 252/174.19; 252/174.21; 252/174.23; 252/174.25

[58] Field of Search ..... 252/174.21, 174.25, 252/528, 534, 544, 547, 558, 559, 174.24, 174.23, 174.19

[56] References Cited

U.S. PATENT DOCUMENTS

| | | | |
|---|---|---|---|
| 3,985,669 | 10/1976 | Krummel et al. | 252/116 |
| 4,166,039 | 8/1979 | Wise | 252/110 |
| 4,560,492 | 12/1985 | Curry et al. | 252/110 |
| 4,689,167 | 8/1987 | Collins et al. | 252/95 |
| 5,071,594 | 12/1991 | Borland et al. | 252/528 |

*Primary Examiner*—Paul Lieberman

*Assistant Examiner*—Erin M. Higgins

*Attorney, Agent, or Firm*—Patricia J. Hogan; Richard J. Hammond

[57] ABSTRACT

A phosphate-free granular laundry detergent having a cleaning performance comparable to that of a premium phosphate-containing laundry detergent has a surfactant content of 1–30% and a detergent builder content of at least 50% by weight and contains:

(A) as its sole surfactant, a mixture of 20–98% by weight of an ethoxylated fatty alcohol corresponding to the formula $Z(OCH_2CH_2)_nOH$ in which Z is an alkyl group containing 8–30 carbons and n is an integer of 1–50, 1–75% by weight of an alkali metal or ammonium salt of an alkylbenzene sulfonate in which the alkyl group contains 10–18 carbons, and 1–20% by weight of an amine oxide corresponding to the formula RR'R''NO in which R is a primary alkyl group containing 8–24 carbons, R' is methyl, ethyl, or 2-hydroxyethyl; and R'' is independently selected from methyl, ethyl, 2-hydroxyethyl, and primary alkyl groups containing 8–24 carbons and (B) as its sole detergent builder, a mixture of a sodium aluminum silicate, an anti-redeposition agent, sodium silicate, and at least one different water-soluble inorganic salt in proportions such that the laundry detergent contains 1–50% by weight of the sodium aluminum silicate, 0.1–5% by weight of the anti-redeposition agent, 1–20% by weight of the sodium silicate, and 10–80% by weight of the different inorganic salt.

16 Claims, No Drawings

GRANULAR LAUNDRY DETERGENT

CROSS-REFERENCE TO RELATED APPLICATION

This application is a continuation-in-part of application Ser. No. 851,600, filed Mar. 16, 1992, now abandoned.

FIELD OF INVENTION

The invention relates to phosphate-free granular laundry detergents and more particularly to such detergents having improved cleaning power.

BACKGROUND

Granular laundry detergents, or laundry powders, typically comprise (A) one or more surfactants, such as alkyl sulfates, alkyl ether sulfates, alkylbenzene sulfonates, ethoxylated alkylphenols, ethoxylated alcohols, or amine oxides, and (B) one or more detergent builders, i.e., components which increase the detergent power of a surfactant and serve important functions such as sequestering undesirable metal ions from washing solutions, protecting anionic surfactants from precipitation, and the other functions mentioned in U.S. Pat. No. 4,689,167 (Collins et al.).

As indicated, e.g., in Collins et al. and in U.S. Pat. No. 4,560,492 (Curry et al.), various detergent builders (including sodium aluminum silicates) have been tested as substitutes for the environmentally-undesirable polyphosphates which were the preferred detergent builder components of these detergents at one time. However, the phosphate-free detergents hitherto obtained by replacing phosphate builders with other builders have required the use of relatively expensive materials and/or suffered a considerable loss in cleaning power because of that replacement.

SUMMARY OF INVENTION

It has been found that a phosphate-free granular laundry detergent can have a cleaning performance comparable to that of a phosphate-containing laundry detergent when:

(A) it has a surfactant content of 1–30% and a detergent builder content of at least 50% by weight, (B) its sole surfactant is a mixture of 20–98% by weight of an ethoxylated fatty alcohol corresponding to the formula $Z(OCH_2CH_2)_nOH$ in which Z is an alkyl group containing 8–30 carbons and n is an integer of 1–50, 1–75% by weight of an alkali metal or ammonium salt of an alkylbenzene sulfonate in which the alkyl group contains 10–18 carbons, and 1–20% by weight of an amine oxide corresponding to the formula RR′R″NO in which R is a primary alkyl group containing 8–24 carbons, R′ is methyl, ethyl, or 2-hydroxyethyl; and R″ is independently selected from methyl, ethyl, 2-hydroxyethyl, and primary alkyl groups containing 8–24 carbons, and (C) its sole detergent builder is a mixture of a sodium aluminum silicate, an anti-redeposition agent, sodium silicate, and at least one different water-soluble inorganic salt in proportions such that the laundry detergent contains 1–50% by weight of the sodium aluminum silicate, 0.1–5% by weight of the anti-redeposition agent, 1–20% by weight of the sodium silicate, and 10–80% by weight of the different inorganic salt.

DETAILED DESCRIPTION

The surfactant which comprises 1–30% by weight of the laundry detergent is preferably employed in an amount such as to constitute 10–20% of the total detergent weight, and its components are preferably proportionated so that the surfactant consists of at least 80% by weight of the ethoxylated fatty alcohol and up to 10% by weight of each of the other components. A particularly preferred proportionation of the surfactant components is 90% by weight of the ethoxylated fatty alcohol, 5% by weight of the alkylbenzene sulfonate, and 5% by weight of the amine oxide.

Ethoxylated fatty alcohols which may be used in the practice of the invention are ordinarily compounds corresponding to the formula $Z(OCH_2CH_2)_nOH$ in which Z is an alkyl group containing an average of at least eight carbons (usually containing 8–30 carbons, preferably 10–18 carbons) and n is an integer of 1–50, preferably 2–15. Particularly preferred ethoxylated fatty alcohols are apt to be (1) the ethoxylate of a mixture of $C_6$ and $C_{10}$ alcohols in which n is 3, (2) the ethoxylate of a mixture of $C_{12}$ and $C_{14}$ alcohols in which n is 3, and (3) the ethoxylate of a mixture of $C_{12}$ and $C_{14}$ alcohols in which n is 6. However, other ethoxylates corresponding to the formula, such as those formed from octanol, decanol, dodecanol, tetradecanol, pentadecanol, hexadecanol, octadecanol, eicosanol, docosanol, tetracosanol, triacontanol, and mixtures thereof with one another and/or with lower alkanols like butanol, isobutanol, and hexanol, are also utilizable.

The alkylbenzene sulfonate component of the laundry detergent may be any alkali metal or ammonium salt of an alkylbenzene sulfonate in which the alkyl group contains 10–18 carbons, but it is preferably sodium dodecylbenzene sulfonate.

As already indicated, the amine oxide component may be a compound containing one or two long-chain alkyl groups. The utilizable amine oxides include, e.g., N-octyldimethylamine oxide, N,N-didecylmethylamine oxide, N-decyl-N-dodecylethylamine oxide, N-dodecyldimethylamine oxide, N-tetradecyldimethylamine oxide, N-tetradecyl-N-ethylmethylamine oxide, N-tetradecyl-N-ethyl-2-hydroxyethylamine oxide, N,N-ditetradecyl-2-hydroxyethylamine oxide, N-hexadecyldimethylamine oxide, N-hexadecyldi-2-hydroxyethylamine oxide, N-octadecyldimethylamine oxide, N,N-dieicosylethylamine oxide, N-docosyl-N-2-hydroxyethylmethylamine oxide, N-tetracosyldimethylamine oxide, and mixtures thereof. Particularly preferred are the amine oxides containing one long-chain alkyl group, e.g., N-tetradecyldimethylamine oxide.

Although the amine oxide used in the practice of the invention may be a conventional amine oxide, i.e., one prepared as a dilute aqueous solution, the need for such amine oxides to be dried in the production of a laundry powder makes it preferable for the amine oxide to be one that has been prepared in solid form, such as the amine oxide dihydrates and dihydrate-containing materials of U.S. Pat. No. 5,071,594 (Borland et al.).

The components of the detergent builder mixture are (1) a sodium aluminum silicate, which may be any suitable zeolite (e.g., zeolite A, X, or Y) but is preferably zeolite A, (2) an anti-redeposition agent, such as sodium polyacrylate or other acrylate polymer, sodium carboxymethylcellulose, and the other materials commonly employed as anti-redeposition agents, (3) sodium silicate, and (4) at least one different water-soluble inorganic salt, such as an alkali metal (usually sodium) sulfate, carbonate, or bicarbonate. In the laundry detergents of the invention, these components are proportionated so that the detergent contains 1–50%, preferably 20–40%, by weight of the sodium aluminum silicate; 0.1–5%, preferably 0.1–1%, by weight of the anti-redeposition agent; 1–20%, preferably 5–15%, by weight of the sodium silicate; and 10–80% by weight of the different inorganic salt.

In addition to the aforementioned essential components, the laundry detergent may also contain up to 20% by weight of optional ingredients if desired. Exemplary of such ingredients apt to be desired are one or more bleaching agents, such as sodium percarbonate or perborate, and one or more of the fabric softeners, such as quaternary ammonium salts, sometimes used in laundry detergents.

The laundry detergents of the invention are advantageous in that they match premium phosphate-containing detergents in performance while being free of (1)the phosphates that are already of environmental concern and (2) any unusual ingredients that would require new environmental or toxicological testing. Moreover, they are effective over a wide range of soils and conditions; impart softening to laundered fabrics even without the inclusion of additional fabric softeners, such as the quaternary ammonium salts mentioned above; and can actually be less costly to make than premium phosphate-containing and phosphate-free laundry detergents that are already commercially available.

The following examples are given to illustrate the invention and are not intended as a limitation thereof. Unless otherwise specified, quantities mentioned in the examples are quantities by weight.

EXAMPLE 1

Three laundry detergents were prepared from the indicated number of parts of the ingredients shown in Table I to produce Blend A (a phosphate-free laundry detergent of the invention), Blend B (a phosphate-free control laundry detergent), and Blend C (a phosphate-containing control laundry detergent)—the two control blends being formulated to match premium commercial laundry detergents.

TABLE I

| Ingredients | Blend A | Blend B | Blend C |
|---|---|---|---|
| N-tetradecyldimethylamine oxide | 1 | 0 | 0 |
| Sodium dodecylbenzene sulfonate | 1 | 13 | 10 |
| 6-EO ethoxylate of a mixture of $C_{12}$ and $C_{14}$ alcohols | 18 | 0 | 0 |
| Soda ash | 41.6 | 22 | 24 |
| Sodium sulfate | 0 | 25 | 25 |
| Sodium silicate | 8 | 2 | 5 |
| Sodium carboxymethylcellulose | 0 | 1 | 1 |
| Sodium polyacrylate | 0.4 | 0 | 0 |
| Zeolite A | 30 | 30 | 0 |
| Tetradecyl sulfate | 0 | 7 | 5 |
| Sodium tripolyphosphate | 0 | 0 | 30 |

EXAMPLE 2

Part A

The cleaning performance of each of the laundry detergents of Example 1 was tested by (1) placing six standard dust-sebum soiled cotton/polyester swatches in a vessel containing one liter of 200 ppm hard water ($Ca^{++}/Mg^{++}$ ratio of 3/2), (2) adding 1.5 g of the detergent to be tested, (3) agitating the contents of the vessel for ten minutes at 100 rpm, (3) rinsing the swatches with the hard water for five minutes at the same temperature used for the washing, (4) drying the rinsed swatches on a flat bed press for ten minutes, (5) measuring the reflectance of each of the swatches in a tergotometer, (6) averaging the results, and (7) calculating the difference between the average reflectance and the reflectance of a zero control as the detergency (L). In one test, the temperature used was 38° C., the temperature now most commonly used for laundering; and temperatures of 22° C. and 55° C. were used in two other tests. The results of the tests are shown in Table II.

Part B

Part A was repeated except that EMPA 101 (a mixture of motor oil and charcoal) soiled swatches were used instead of the dust-sebum soiled swatches. The results of the tests are shown in Table II.

Part C

Part A was repeated except that clay soiled swatches were substituted for the dust-sebum soiled swatches. The results of the tests are shown in Table II.

TABLE II

| | | Increase in Reflectance | | |
|---|---|---|---|---|
| Soil Type | Test Temperature | Blend A | Blend B | Blend C |
| Dust-sebum | 38° C. | 24.1 | 18.8 | 24.0 |
| | 55° C. | 24.0 | 18.5 | 21.2 |
| | 22° C. | 22.5 | 16.0 | 23.5 |
| EMPA 101 | 38° C. | 21.2 | 22.2 | 19.8 |
| | 55° C. | 20.5 | 22.0 | 21.0 |
| | 22° C. | 15.5 | 14.8 | 14.8 |
| Clay | 38° C. | 14.7 | 14.1 | 15.0 |
| | 55° C. | 15.0 | 13.8 | 16.0 |
| | 22° C. | 14.0 | 13.1 | 14.1 |

As demonstrated above, the laundry detergent of the invention compares very favorably with premium commercial laundry detergents in cleaning performance when used in water having a hardness of 200 ppm Ca and in an amount comparable to one cup of detergent in a normal washing machine. The following examples show that a favorable comparison in its performance is also found when the water used for the test has different degrees of hardness or when different amounts of detergent are utilized.

EXAMPLE 3

Example 2 was repeated at 38° C. on dust-sebum soiled swatches except that the water hardness was varied as shown in Table III, which also shows the increases in reflectance determined by the tests.

TABLE III

| | | Increase in Reflectance | | |
|---|---|---|---|---|
| Soil Type | ppm Ca in Water | Blend A | Blend B | Blend C |
| Dust-sebum | 0 | 27.0 | 25.9 | 27.9 |
| | 50 | 25.9 | 26.1 | 26.9 |
| | 100 | 25.9 | 24.0 | 26.9 |
| | 150 | 25.0 | 19.5 | 25.9 |
| | 200 | 24.1 | 18.8 | 24.0 |
| | 250 | 21.9 | 15.3 | 18.5 |
| | 300 | 20.0 | 15.1 | 18.5 |
| | 350 | 17.9 | 15.0 | 18.1 |
| | 400 | 18.1 | 15.5 | 17.9 |

EXAMPLE 4

Example 2 was repeated at 38° C. on dust-sebum soiled swatches except that (1) the polyester/cotton swatches were of a material provided by a different manufacturer and had a higher loading of soil and (2) the amount of detergent employed was varied as shown in Table IV, which also shows the increases in reflectance determined by the tests.

TABLE IV

| | | Increase in Reflectance | | |
|---|---|---|---|---|
| Soil Type | g Detergent per L Water | Blend A | Blend B | Blend C |
| Dust-sebum | 0.5 | 11.0 | 5.9 | 6.5 |
| | 1.0 | 15.0 | 13.0 | 11.5 |
| | 1.5 | 19.9 | 15.0 | 20.0 |
| | 2.0 | 20.5 | 16.0 | 22.0 |
| | 2.5 | 22.0 | 21.0 | 22.0 |
| | 3.0 | 22.5 | 21.5 | 22.6 |
| | 3.5 | 23.0 | 21.5 | 23.0 |

What is claimed is:

1. A phosphate-free granular detergent having a surfactant content of 1–30% and a detergent builder content of at least 50% by weight and comprising:

(A) a surfactant mixture consisting of 20–98% by weight of an ethoxylated fatty alcohol corresponding to the formula $Z(OCH_2CH_2)_nOH$ in which Z is an alkyl group containing 8–30 carbons and n is an integer of 1–50, 1–75% by weight of an alkali metal or ammonium salt of an alkylbenzene sulfonate in which the alkyl group contains 10–18 carbons and 1–20% by weight of an amine oxide corresponding to the formula RR'R"NO in which R is a primary alkyl group containing 8–24 carbons, R' is methyl, ethyl, or 2-hydroxyethyl and R" is independently selected from methyl, ethyl, 2-hydroxyethyl, and primary alkyl groups containing 8–24 carbons and (B) a detergent building mixture consisting of a sodium aluminum silicate, and anti-redeposition agent selected from the group consisting of sodium polyacrylate, sodium carboxymethylcellulose and mixtures thereof, sodium silicate, and at least one different water-soluble inorganic salt selected from the group consisting of sodium sulfate, sodium carbonate and sodium bicarbonate in proportions that the laundry detergent contains 1–50% by weight of the sodium aluminum silicate, 0.1–5% by weight of the anti-redeposition agent, 1–20% by weight of the sodium silicate, and 10–80% by weight of the different inorganic salt.

2. The laundry detergent of claim 1 wherein the ethoxylated fatty alcohol is a compound corresponding to the formula $Z(OCH_2CH_2)_nOH$ in which Z is an alkyl group containing 10–18 carbons and n is an integer of 2–15.

3. The laundry detergent of claim 2 wherein the ethoxylated fatty alcohol is the ethoxylate of a mixture of $C_{12}$ and $C_{14}$ alcohols in which n is 6.

4. The laundry detergent of claim 1 wherein the alkylbenzene sulfonate component is sodium dodecylbenzene sulfonate.

5. The laundry detergent of claim 1 wherein the R' and R" of the amine oxide formula are independently selected from methyl, ethyl, and 2-hydroxyethyl.

6. The laundry detergent of claim 5 wherein both R' and R" are methyl.

7. The laundry detergent of claim 6 wherein the amine oxide is N-tetradecyldimethylamine oxide.

8. The laundry detergent of claim 1 wherein the surfactant consists of a mixture of at least 80% by weight of an ethoxylated fatty alcohol corresponding to the formula $Z(OCH_2CH_2)_nOH$ in which Z is an alkyl group containing 10–18 carbons and n is an integer of 2–15, up to 10% by weight of sodium dodecylbenzene sulfonate, and up to 10% by weight of an amine oxide corresponding to the formula RR'R"NO in which R is a primary alkyl group containing 8–24 carbons and R' and R" are independently selected from methyl, ethyl, and 2-hydroxyethyl.

9. The laundry detergent of claim 8 wherein the surfactant consists of a mixture of 90% by weight of the ethoxylate of a mixture of $C_{12}$ and $C_{14}$ alcohols in which n is 6, 5% by weight of sodium dodecylbenzene sulfonate, and 5% by weight of N-tetradecyldimethylamine oxide.

10. The laundry detergent of claim 1 wherein the sodium aluminum silicate is zeolite A.

11. The laundry detergent of claim 1 wherein the anti-redeposition agent is sodium polyacrylate.

12. The laundry detergent of claim 1 wherein the different inorganic salt is sodium carbonate.

13. The laundry detergent of claim 1 comprising 10–20% by weight of the surfactant, 20–40% by weight of the sodium aluminum silicate, 0.1–1% by weight of the anti-redeposition agent, and 5–15% by weight of the sodium silicate.

14. The laundry detergent of claim 13 wherein (A) the surfactant consists of a mixture of at least 80% by weight of an ethoxylated fatty alcohol corresponding to the formula $Z(OCH_2CH_2)_nOH$ in which Z is an alkyl group containing 10–18 carbons and n is an integer of 2–15, up to 10% by weight of sodium dodecylbenzene sulfonate, and up to 10% by weight of an amine oxide corresponding to the formula RR'R"NO in which R is a primary alkyl group containing 8–24 carbons and R' and R" are independently selected from methyl, ethyl, and 2-hydroxyethyl, (B) the sodium aluminum silicate is zeolite A, (C) the anti-redeposition agent is selected from sodium polyacrylate, sodium carboxymethylcellulose, and mixtures thereof, and (D) the different inorganic salt is one or more compounds selected from sodium sulfate, sodium carbonate, and sodium bicarbonate.

15. The laundry detergent of claim 14 wherein (A) the surfactant consists of a mixture of 90% by weight of the ethoxylate of a mixture of $C_{12}$ and $C_{14}$ alcohols in which n is 6, 5 % by weight of sodium dodecylbenzene sulfonate, and 5% by weight of N-tetradecyldimethylamine oxide, (B) the anti-redeposition agent is sodium polyacrylate, and (C) the different inorganic salt is sodium carbonate.

16. The laundry detergent of claim 15 consisting of 20% by weight of the 243 surfactant mixture, 30% by weight of zeolite A, 0.4% by weight of sodium polyacrylate, 8% by weight of sodium silicate, and 41.6% by weight of sodium carbonate.

* * * * *